US009697975B2

(12) United States Patent
Maloney et al.

(10) Patent No.: US 9,697,975 B2
(45) Date of Patent: Jul. 4, 2017

(54) CIRCUIT BREAKERS WITH MOVING CONTACT ARM WITH SPACED APART CONTACTS

(71) Applicant: Eaton Corporation, Cleveland, OH (US)

(72) Inventors: James Gerard Maloney, Industry, PA (US); Luis Enrique Betances Sansur, Santo Domingo (DO)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 14/698,192

(22) Filed: Apr. 28, 2015

(65) Prior Publication Data

US 2016/0163488 A1 Jun. 9, 2016

Related U.S. Application Data

(63) Continuation-in-part of application No. 14/559,276, filed on Dec. 3, 2014.

(51) Int. Cl.

| | |
|---|---|
| ***H01H 75/00*** | (2006.01) |
| ***H01H 77/00*** | (2006.01) |
| ***H01H 71/24*** | (2006.01) |
| ***H01H 71/02*** | (2006.01) |
| ***H01H 9/38*** | (2006.01) |
| ***H01H 73/04*** | (2006.01) |
| *H01H 1/22* | (2006.01) |

(52) U.S. Cl.

CPC ..... *H01H 71/2472* (2013.01); *H01H 9/38* (2013.01); *H01H 71/02* (2013.01); *H01H 73/04* (2013.01); *H01H 1/225* (2013.01)

(58) Field of Classification Search

CPC ..... H01H 71/501
USPC ..... 335/200–201
See application file for complete search history.

(56) References Cited

U.S. PATENT DOCUMENTS

| | | | | |
|---|---|---|---|---|
| 847,520 | A * | 3/1907 | Smythe et al. | H01H 71/2472 200/500 |
| 1,030,435 | A * | 6/1912 | Schureman | H01H 50/323 335/161 |
| 1,122,430 | A * | 12/1914 | Scott | H01H 71/501 335/166 |
| 3,020,374 | A * | 2/1962 | Tootelian | H01H 1/54 218/16 |
| 3,076,882 | A * | 2/1963 | Judd | H01H 33/12 218/21 |
| 3,585,329 | A * | 6/1971 | Walker | H01H 9/383 218/15 |

(Continued)

FOREIGN PATENT DOCUMENTS

WO WO2014/088714 6/2014

OTHER PUBLICATIONS

Office Action corresponding to U.S. Appl. No. 14/559,276 (10 pages) (mailed Aug. 8, 2016).

*Primary Examiner* — Alexander Talpalatski
(74) *Attorney, Agent, or Firm* — Myers Bigel, P.A.

(57) ABSTRACT

Circuit breakers with moving contacts having a rocking movement, e.g., heel-toe action, are configured to direct arcing across one of two (first and second) spaced apart contacts on a moving arm to an adjacent arc chute to thereby alleviate deterioration due to arcing and improve conductivity of the first moving contact over time.

21 Claims, 12 Drawing Sheets

(56) References Cited

U.S. PATENT DOCUMENTS 3,605,051 A * 9/1971 Casey ..... H01H 71/501 335/166
3,783,215 A * 1/1974 Brumfield ..... H01H 71/501 200/401
3,849,751 A * 11/1974 Link ..... H01H 71/1054 200/401
4,081,852 A * 3/1978 Coley ..... H02H 3/105 335/37
4,346,356 A * 8/1982 Fujiwara ..... H01H 71/503 335/14
4,489,295 A * 12/1984 Altenhof, Jr. ..... H01H 71/1054 335/166
4,503,408 A 3/1985 Mrenna et al.
4,736,174 A 4/1988 Castonguay et al.
4,786,885 A 11/1988 Morris et al.
4,945,325 A * 7/1990 Toda ..... H01H 71/50 335/16
4,951,020 A * 8/1990 Changle ..... H01H 71/525 335/167
5,089,795 A * 2/1992 Morgan ..... H01H 9/0072 335/193
5,117,211 A * 5/1992 Morgan ..... H01H 9/0072 335/202
5,131,504 A 7/1992 Yoo et al.
5,142,112 A * 8/1992 Parks ..... H01H 71/501 200/401
5,193,043 A * 3/1993 Grunert ..... H01H 83/223 361/105
5,210,385 A * 5/1993 Morel ..... H01H 9/383 218/9
5,359,161 A * 10/1994 Leach ..... H01H 1/225 200/250
5,517,164 A * 5/1996 Zoller ..... H01H 77/105 218/22
5,844,187 A * 12/1998 Thornton ..... H01H 9/386 218/1
5,899,323 A * 5/1999 Rakus ..... H01H 1/226 200/244
6,034,586 A * 3/2000 Runyan ..... H01H 71/1027 218/152
6,239,676 B1 * 5/2001 Maloney ..... H01H 71/7436 335/35
6,274,833 B1 8/2001 Moody
6,689,979 B1 * 2/2004 Bach ..... H01H 9/383 218/22
6,870,115 B1 * 3/2005 Slepian ..... H01H 71/528 200/303
8,222,983 B2 7/2012 Zhou et al.
8,264,232 B2 * 9/2012 Rival ..... H01H 1/0015 200/308
8,542,083 B2 * 9/2013 Maloney ..... H01H 71/522 335/167
2009/0128265 A1 * 5/2009 Sudhakar ..... H01H 71/2409 335/8

* cited by examiner

CIRCUIT BREAKERS WITH MOVING CONTACT ARM WITH SPACED APART CONTACTS

RELATED APPLICATIONS

This application is a continuation-in-part of U.S. patent application Ser. No. 14/559,276, filed Dec. 3, 2014, the contents of which are hereby incorporated by reference as if recited in full herein.

FIELD OF THE INVENTION

The present invention relates to circuit breakers.

BACKGROUND OF THE INVENTION

Circuit breakers are one of a variety of overcurrent protection devices used for circuit protection and isolation. The circuit breaker provides electrical protection whenever an electric abnormality occurs. In a typical circuit breaker, current enters the system from a power line and passes through a line conductor to a stationary contact fixed on the line conductor, then to a movable contact. The movable contact is fixedly attached to a pivoting arm. As long as the stationary and movable contacts are in physical contact, current passes between the stationary contact and the movable contact and out of the circuit breaker to down-line electrical devices.

In the event of an overcurrent condition (e.g., a short circuit), extremely high electromagnetic forces can be generated. The electromagnetic forces can be used to separate the movable contact from the stationary contact. Upon separation of the contacts, an arcing condition occurs. The breaker's trip unit will trip the breaker which will cause the contacts to separate.

SUMMARY OF EMBODIMENTS OF THE INVENTION

Embodiments of the invention are directed to circuit breakers with moving arms having first and second spaced apart contacts which can operate with heel-toe action to direct arcing from a second contact across a stationary contact surface to arc chutes to thereby alleviate deterioration due to arcing and/or improve conductivity of the first moving contact surface over time.

A circuit breaker comprising: a moveable contact arm, the contact arm having first and second cooperating arm members coupled together, the first arm member engaging a pivotable handle and the second arm member comprising first and second spaced apart electrical contacts.

The second arm member can be configured to translate the first and second contacts in a rocking action so that the first contact moves away from at least one stationary contact after the second contact engages the at least one stationary contact immediately prior to an arcing event.

A lower end portion of the first arm member can be pivotably attached to an upper end portion of the second arm member. The circuit breaker further can include a link that extends from a top portion of the first arm to the second arm above the first and second contacts to rotate the second arm and facilitate the rocking action when the upper arm starts to rotate.

The circuit breaker can include first and second spaced apart stationary contacts and an arc chute. The second contact of the second arm member can reside closer to the arc chute than the first contact. The first contact can be a continuous use contact and the second contact can engage the second stationary contact while the first contact is spaced apart from the first stationary contact when the contact arm moves toward an "OFF" position and/or in an opening position to thereby direct arcing into the arc chute.

The breaker can include a coupler affixed to the first arm member. The coupler can have a slot. The second arm member can also have a slot. The slot of the coupler and the slot of the second arm member can be aligned with a pin extending therethrough and allow the pin to travel inward, outward, upward and downward while the pin remains in the slots to place the second arm member and first and second electrical contacts in different positions.

The first arm member can hold a lower end of a mechanism spring. The first arm member can apply a downwardly extending force vector to the second arm member. The breaker can include a resilient member extending down from the first arm member to reside behind the second arm member. The resilient member can be configured to apply an upwardly extending force vector.

The first arm member can have a curvilinear receiving pocket that faces an upper end of the second arm member and holds a spring that transmits the downwardly extending first force vector.

A resilient member can extend down from a back surface of the first arm member to reside behind a back surface of the second arm member. The resilient member can have first and second linear segments with the second linear segment angularly extending between about 100-160 degrees from the first linear segment.

The second arm member holds the first contact on one corner and has a downwardly extending leg that holds the second contact.

The first and second contact members can be spaced apart from each other between about 0.030 inches and about 0.234 inch. The second contact arm can have an open space or recess between the first and second contact members.

The second arm member can have an upwardly extending slot. The circuit breaker can further include a coupler that is attached to the first arm member and has an elongate slot. The coupler slot and the second arm member slot can engage a pin that allows the second arm member to move relative to the first arm member through defined positions.

The circuit breaker can include at least one shaped flat resilient member having first and second linear segments separated by a bend so that the second linear segment extends at an angle greater than 90 degrees away from the first linear segment. The first linear segment can be attached to and extends below the first arm member behind the second member to force the second arm member to rotate forward.

The circuit breaker can include a mechanism spring held by a lower end of the first arm member. The first arm member can include a knee that resides above the lower end of the first arm member that faces the mechanism spring. The lower end segment of the first arm member can have a smaller width than a width of the second arm member adjacent thereto and can resides spaced apart a distance from an adjacent underlying portion of the second arm member.

The circuit breaker can also include first and second spaced apart stationary contacts on a contact support. The first contact of the second arm member of the contact arm can be aligned with the first stationary contact and the second contact of the second arm member of the contact arm can be aligned with the second stationary contact. The second arm member can be configured to move relative to the first arm member to position the second contact of the contact arm against the second stationary contact while the first contact of the contact arm is spaced apart from the first stationary contact when the circuit breaker is in an OPENING position (moving toward OFF).

The circuit breaker can include first and second spaced apart stationary contacts on a contact support. The first contact of the contact arm can be aligned with the first stationary contact and the second contact of the contact arm can be aligned with the second stationary contact. The second arm member can be configured to move relative to the first arm member to: (a) position the first contact of the contact arm against the first stationary contact while the second contact of the contact arm is spaced apart from the second stationary contact when the circuit breaker is in an ON position, (b) position the second contact of the contact arm against the secondary stationary contact while the first contact of the contact arm is spaced apart from the first stationary contact when the circuit breaker is in an OPENING position (moving toward OFF), and (c) position the first and second contacts of the contact arm away from the first and second stationary contacts in an OFF and TRIPPED position.

Other embodiments are directed to methods of operating a circuit breaker. The methods include: providing a circuit breaker with a moving contact arm having first and second spaced apart contacts; rocking the first and second spaced apart contacts against at least one stationary contact so that the first contact is against the stationary contact, while the second contact is placed against the at least one stationary contact, then the first contact is moved away from the at least one stationary contact immediately prior to an arcing action after the second contact engages a respective at least one stationary contact; and directing arcing through the second contact and engaged stationary contact down into an adjacent arc chute providing an arc-free contact surface of the moving contact arm first contact.

The stationary contact can be configured as first and second spaced apart stationary contacts. The second stationary contact can be aligned with the second contact of the moving contact arm. The rocking step can be carried out so that the first contact of the moving contact arm is spaced apart from the first and second stationary contacts immediately prior to an arcing event.

The moving contact arm step can use first and second cooperating arm members coupled together with at least one pin and cooperating slots, and a resilient member extending behind the second arm member. The rocking step comprises translating the pin to move into different positions while held in the slots and pushing the second arm member to move relative to the first arm member to position the first and second contacts against the at least one stationary contact in a defined sequence.

The method can include applying spring force vectors to the lower arm member during the rocking action that (i) push an inner facing surface of the lower arm member downward and (ii) push an outer facing surface of the lower arm member inward.

The method can include applying a first spring force against a lower arm member of a moveable contact arm by mechanically pushing at least one resilient member against the lower arm member to rotate the lower arm member clockwise when opening and applying a second spring force using a spring attached to an upper arm member of the moveable contact arm, the lower arm member configured to move inward, outward and up and down relative to the upper arm member whereby the second spring force is stronger than the first spring force so as to rock the lower arm member counter clockwise once in an "ON" position.

Yet other embodiments are directed to circuit breakers. The circuit breakers include: a housing; a pivotable handle held by the housing; and a moveable contact arm held in the housing. The arm has first and second cooperating arm members, the first arm member engaging the pivotable handle and the second arm member comprising first and second spaced apart electrical contacts with at least one elongate slot. A pin extends through the slot and allows the second arm member to translate inward, outward, upward and downward relative to the first arm member. The breakers also include first and second spaced apart stationary contacts in the housing, the first stationary contact aligned with the first electrical contact of the second arm member and the second stationary contact aligned with the second electrical contact of the second arm member. The first electrical contact of the second arm member is configured to move to reside against only the first stationary contact and the second electrical contact of the second arm member is configured to move to reside against only the second stationary contact, wherein, in an opening state and/or moving toward "OFF" position, prior to an arcing event, the first contact of the second arm member is spaced apart from first stationary contact while the second contact of the second arm member is against the second stationary contact to thereby direct arcing across a surface of the second contact into the arc chute and avoid arcing across surfaces of the first contact and the first stationary contact.

At least one of the stationary contact or the second arm electrical contact includes silver in an amount between about 25 and 97%.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
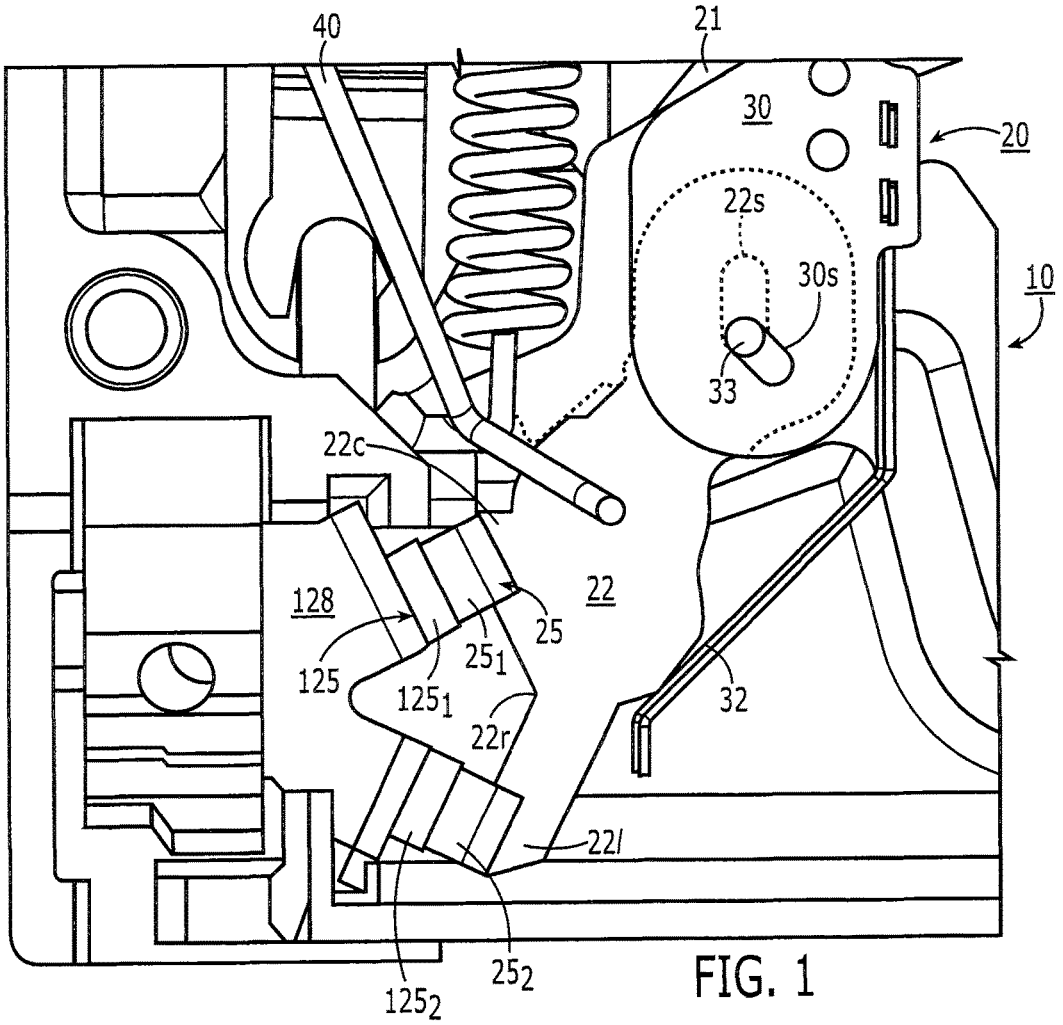
FIG. 1 is an enlarged partial view of a circuit breaker with a moving contact arm with first and second spaced apart contacts according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 40, 40', 40", 40'").

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art. The term "Fig." (whether in all capital letters or not) is used interchangeably with the word "Figure" as an abbreviation thereof in the specification and drawings. In the figures, certain layers, components or features may be exaggerated for clarity, and broken lines illustrate optional features or operations unless specified otherwise. In addition, the sequence of operations (or steps) is not limited to the order presented in the claims unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "bottom", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass orientations of above, below and behind. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "non-ferromagnetic" means that the noted component is substantially free of ferromagnetic materials so as to be suitable for use in the arc chamber (non-disruptive to the magnetic circuit) as will be known to those of skill in the art.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Turning now to the figures, FIG. 1 illustrates an exemplary configuration of a conductive arm 20 with a moving contact 25 that engages a stationary contact 125 for a circuit breaker 10. As shown, the moving contact 25 is defined by spaced apart first and second (moving) contacts $\mathbf{25}_1$, $\mathbf{25}_2$. The contacts $\mathbf{25}_1$, $\mathbf{25}_2$ are configured to selectively engage a stationary contact 125 which can be a single physical contact for both the first and second contacts $\mathbf{25}_1$, $\mathbf{25}_2$ or may be provided as first and second spaced apart contacts $\mathbf{125}_1$, $\mathbf{125}_2$, as shown. The contacts $\mathbf{25}_1$, $\mathbf{25}_2$ can be spaced apart different distances for different applications. In some embodiments, the contacts are spaced apart (shown vertically spaced apart in the orientation of the breaker shown in the figures) a distance of between about 0.03 inches to about 1 inch, typically between about 0.03 and 0.5 inches.

As is also shown in FIG. 1, the conductive arm 20 can have first and second discrete cooperating arm members 21, 22 that can be attached with a coupler 30. The contacts $\mathbf{25}_1$, $\mathbf{25}_2$ can be separate, discrete components that are longitudinally spaced apart so that one resides above the other on a lower portion or end of the arm 20 (shown as on lower arm member 22). An optional resilient member 32 can extend inward below the handle 15 on a side of the arm 20 opposing the contacts $\mathbf{25}_1$, $\mathbf{25}_2$ as will be discussed further below.

The lower end 22*e* of the arm 20 and/or lower member 22 can have two spaced apart outer edges 22*o* with a recess therebetween 22*r*. The first contact $\mathbf{25}_1$ can be held above the lower contact $\mathbf{25}_2$. The lower end of the second arm member 22 can have the respective spaced apart portions that hold the first and second contacts $\mathbf{25}_1$, $\mathbf{25}_2$.

The lower end can have a perimeter which includes a first (typically upper) corner 22*c* on one side and a projecting leg 22*l* on the other, the first corner 22*c* holds the first contact $\mathbf{25}_1$ and the leg 22*l* holds contact $\mathbf{25}_2$. The lower end 22*e* of the arm 20, typically lower arm member 22, can be split or forked to define the contact holding regions/segments 22*c*, 22*l* with the recess 22*r* therebetween. The leg 22*l* typically extends a greater distance out from the primary body of the second/lower arm member 22 than the upper corner 22*c*.

Figure 2A:
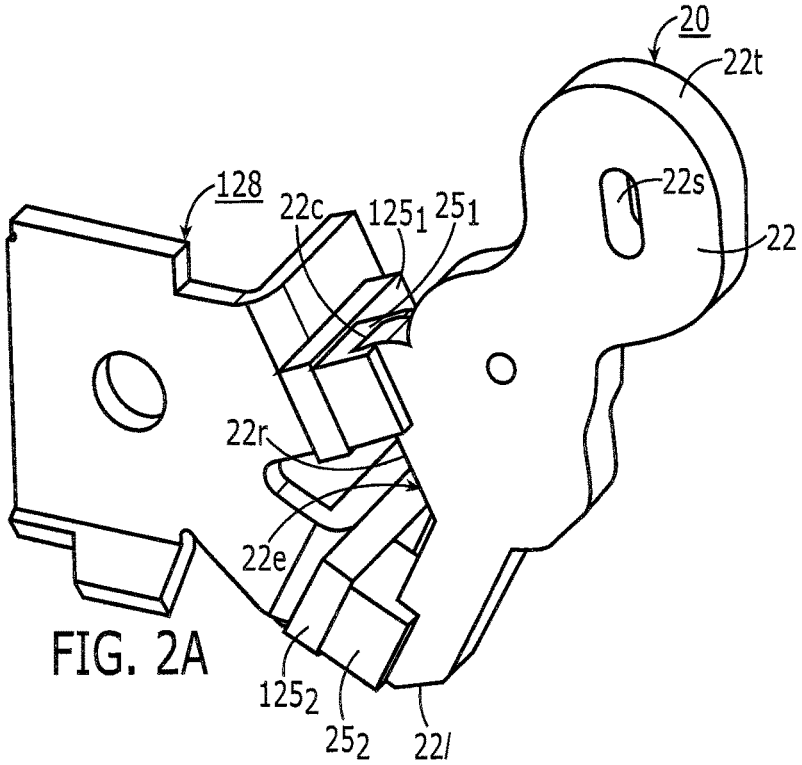
FIG. 2A is a side perspective view of an exemplary moving arm with first and second spaced apart moving contacts engaged with first and second stationary contacts according to embodiments of the present invention.
Figure 2B:
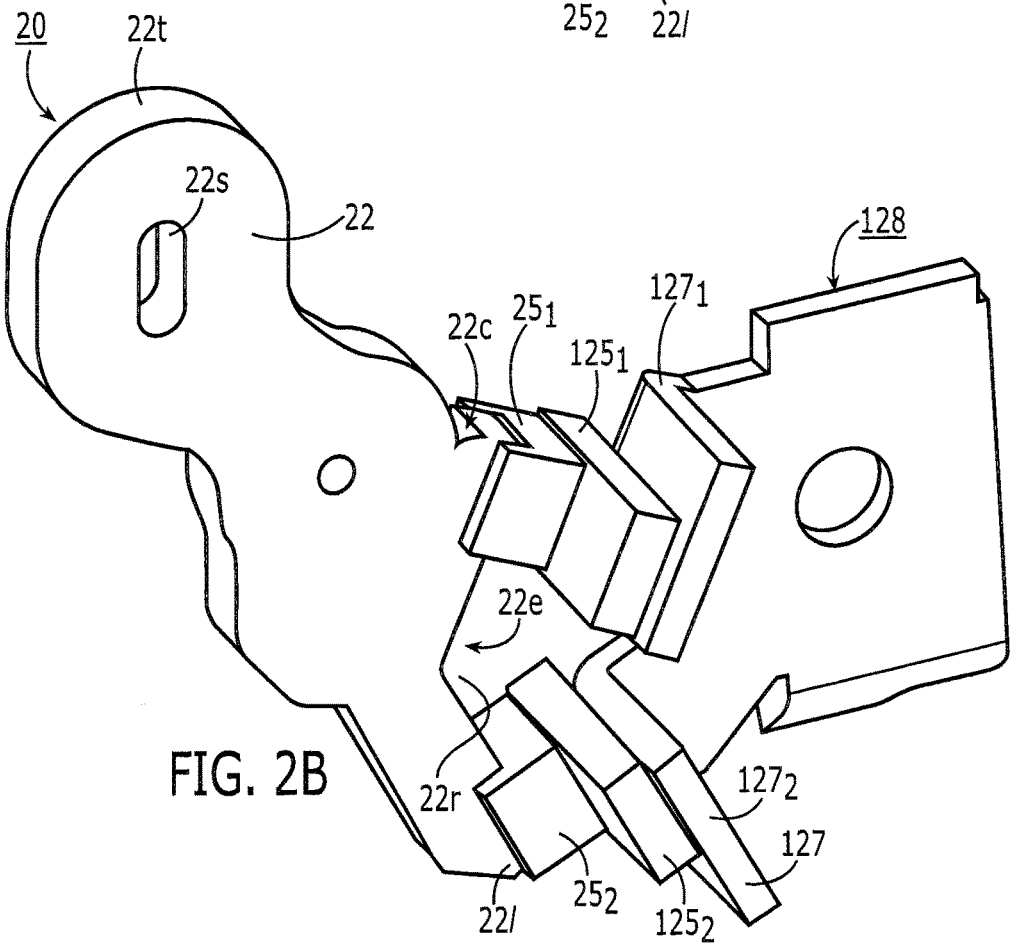
FIG. 2B is an opposing and enlarged side view of the components shown in FIG. 2A according to embodiments of the present invention.

FIGS. 2A and 2B illustrate an example of the second member 22 of the arm 20 apart from the first member 21 and other components. As shown, the second arm member 22 has a top portion 22*t* and a lower end 22*e* and a slot 22*s* that cooperates with the slot 30*s* of the coupler 30 to allow the contacts $\mathbf{25}_1$, $\mathbf{25}_2$ to move through various operative positions spaced apart from and contacting the stationary contact(s) 125. A pin 33 can engage both slots 30*s*, 22*s* and allow the arm members 21, 22 to travel to independently place the first and second contacts $\mathbf{25}_1$, $\mathbf{25}_2$ at the desired positions to avoid arcing across the face of the first contact $\mathbf{25}_1$.

Referring to FIGS. 1, 2A and 2B, for example, the stationary contact 125 can be provided as a stationary contact assembly 128 that includes a conductive support 127 that holds the stationary contact 125. The assembly 128 can be configured with spaced apart first and second supports $\mathbf{127}_1$, $\mathbf{127}_2$ that hold respective contacts $\mathbf{125}_1$, $\mathbf{125}_2$ as shown. The contacts 125 and supports 127 can be planar and oriented at an angle between about 10 to about 60 degrees from vertical. However, as noted above, other stationary contact configurations may be used such as, for example, a single contact 125 for both the moving contacts $\mathbf{25}_1$, $\mathbf{25}_2$.

Figure 3A:
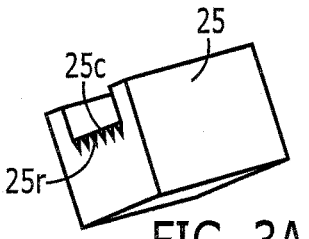
FIG. 3A is an enlarged side perspective view of an exemplary moving contact member for the moving contact arm shown in FIGS. 1 and 2A according to some embodiments of the present invention.

FIG. 3A illustrates an exemplary contact 25 that can be a separate component that is attached to the arm 20. However, in other embodiments, the arm second member 22 may be fabricated to include integral first and/or second contacts $\mathbf{25}_1$, $\mathbf{25}_2$. As shown, the contact 25 has a box like shape with a channel 25*c* that receives and attaches to a correspondingly shaped end of the arm. However, planar contacts 25 or other shaped channels may be used for the contacts 25. Planar contacts may be more economic. Both the first and second contacts $\mathbf{25}_1$, $\mathbf{25}_2$ can have the same shape and size. Alternatively, each can have a different shape and/or size. The channel 25*c* can include a floor and/or sidewall with ridges 25*r* to promote a stationary, secure attachment. The contact 25*c* can be releasably attached to the arm member 22 or permanently attached to the arm member 22 by one or more of welding, adhesive attachment, bonding, brazing, frictional engagement and/or other suitable attachment techniques and/or configurations.

Figure 3B:
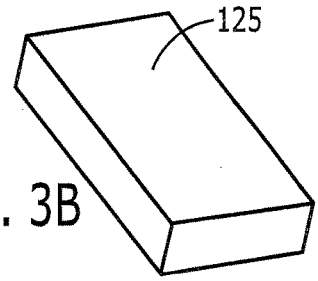
FIG. 3B is an enlarged side perspective view of an exemplary stationary contact according to embodiments of the present invention.

FIG. 3B illustrates an exemplary stationary contact 125. As shown, the contact 125 can be the same shape and size for each of the first and second stationary contacts $\mathbf{125}_1$, $\mathbf{125}_2$ when two such contacts are used. Alternatively, each can have a different shape and/or size. The stationary contact 125 can include a contact pad comprising silver or other conductive material. Where first and second spaced apart stationary contacts $\mathbf{125}_1$, $\mathbf{125}_2$ are used, the first contact $\mathbf{125}_1$ can have the same or a greater amount of silver than the second $\mathbf{125}_2$.

As shown in FIGS. 4A-4D, the circuit breaker 10 has a housing 10*h* with a handle 15 that cooperates with the moving conductive arm 20. The handle 15 pivots and the arm 20 rotates between "OFF" and "ON" positions, and, optionally, a "TRIP" position. During endurance testing per UL 489, the arm 20 rapidly repetitively moves through its operative positions. Operational requirements from UL's "X" Program called "Overload" currently requires a breaker to be toggled 50 times at six (6) times rated current. For example, for a 150 Ampere (Amp) breaker, the six (6) times test current is 900 Amps, which is arcing the contacts 25, 125 fifty (50) times. Afterwards, a temperature rise test is performed and the temperature rise cannot exceed 50 degrees C.

It is also noted that the "heel-toe" action of the separated contacts can be used with other circuit breaker configurations not requiring the magnetic separation.

The conductive contact arm 20 can fit over a handle bearing segment 18 of the handle 15. The handle bearing segment 18 allows the handle 15 and arm 20 to move while the handle 15 remains in contact with the arm 20.

The handle 15 can be associated with a disconnect operator (e.g., an operating handle) connected to an assembly for opening and closing separable main contacts in a circuit breaker 10 or for turning power "ON" and "OFF" using a switch associated with a fuse. The circuit breaker 10 can be for a motor starter unit or feeder unit, for example. It is noted that not all circuit breakers 10 require a "TRIP" position (e.g., fused disconnect switches), so in some embodiments, the arm 25 and handle 15 can include only two operative positions, "ON", "OFF," rather than "ON," "OFF" and "TRIP" positions.

Figure 4A:
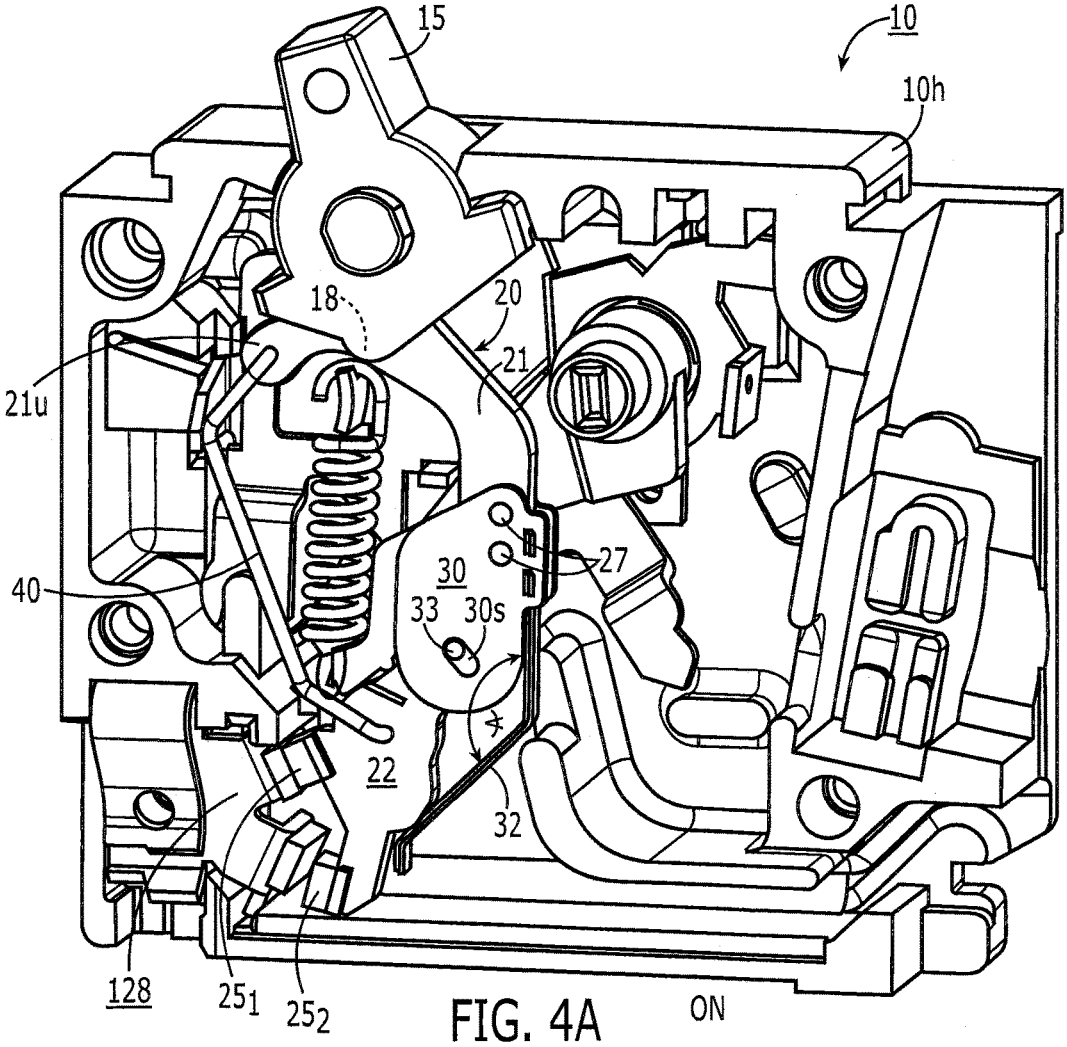
FIG. 4A is a side cutaway view of a circuit breaker illustrating an exemplary ON configuration according to embodiments of the present invention.

Referring to FIG. 4A, the first and second arm members 21, 22 are configured to movably cooperate so that only the first contact $\mathbf{25}_1$ contacts the stationary contact 125 in the "ON" position, while the second contact $\mathbf{25}_2$ is spaced apart from the stationary contact, e.g., the aligned stationary contact $\mathbf{125}_2$. The separation distance of the second contacts $\mathbf{25}_2$, $\mathbf{125}_2$ (measured between the closest corners) in the ON position may vary by type or rating of breaker 10, but may, in some embodiments be between 0.02 and 0.10 inches, such as about 0.040 inches.

Figure 4B:
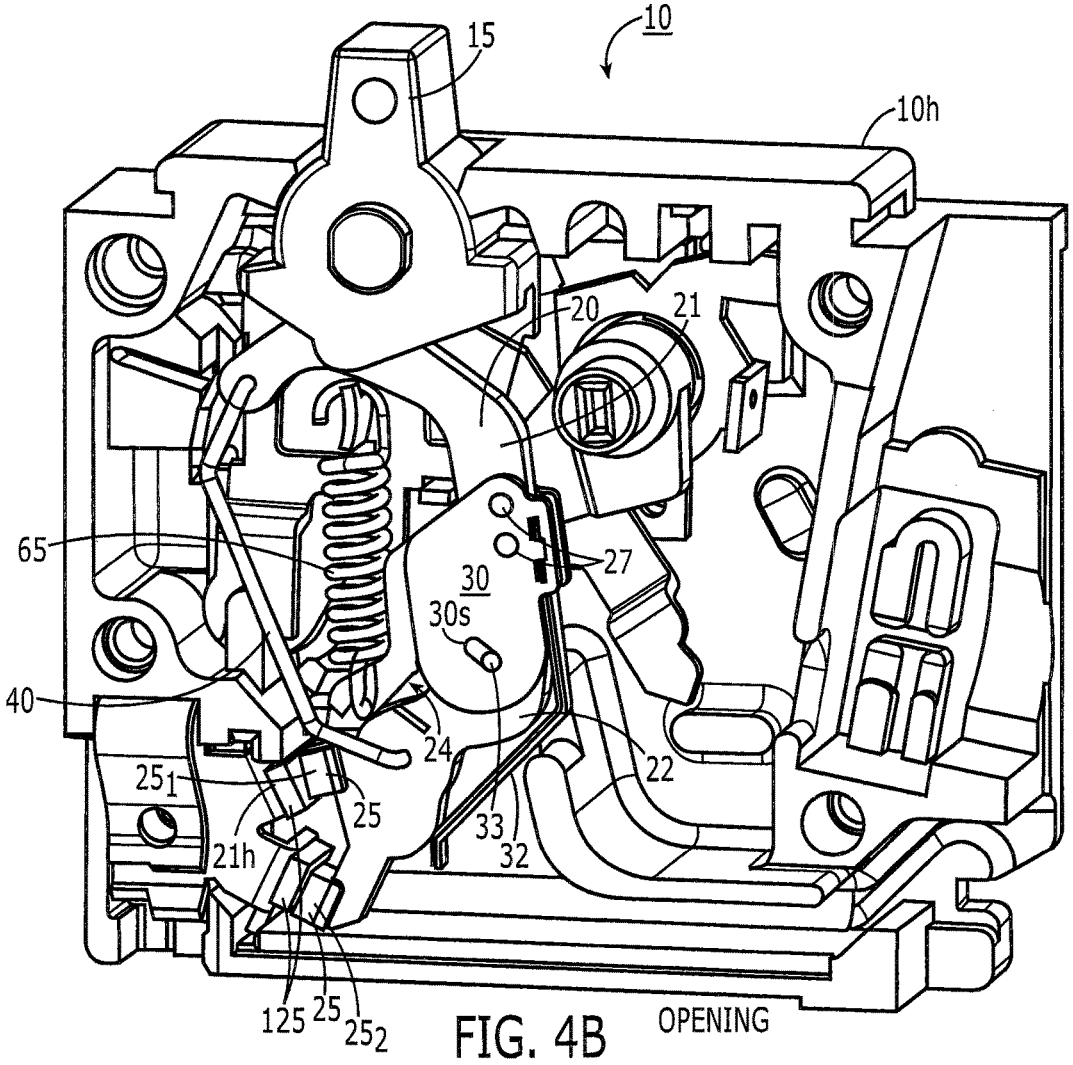
FIG. 4B is a side cutaway view of the circuit breaker shown in FIG. 4A illustrating an exemplary OPENING configuration according to embodiments of the present invention.

Referring to FIG. 4B, only the second contact $\mathbf{25}_2$ contacts the stationary contact 125 in the "Opening" configuration, e.g., as the arm 20 rotates toward the "OFF" position, while the first contact $\mathbf{25}_1$ is spaced apart from the stationary contact, e.g., the aligned stationary contact $\mathbf{125}_2$. The separation distance of the contacts $25_1$, $125_1$ (measured between the closest corners) in the ON position may vary by type or rating of breaker 10, but may, in some embodiments be between about 0.02 and 0.10 inches, such as about 0.030 inches.

Figure 4C:
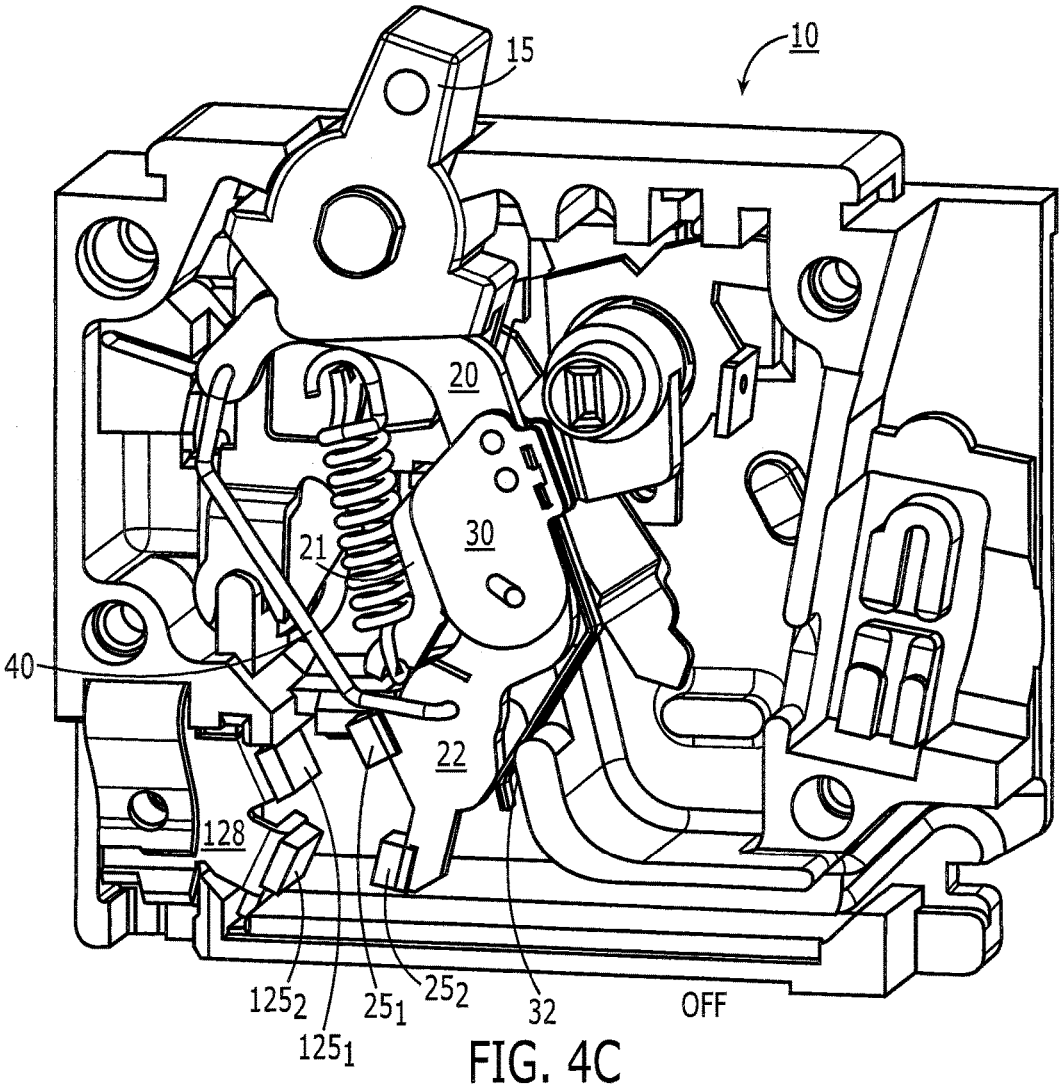
FIG. 4C is a side cutaway view of the circuit breaker shown in FIG. 4A illustrating an exemplary OFF configuration according to embodiments of the present invention.
Figure 4D:
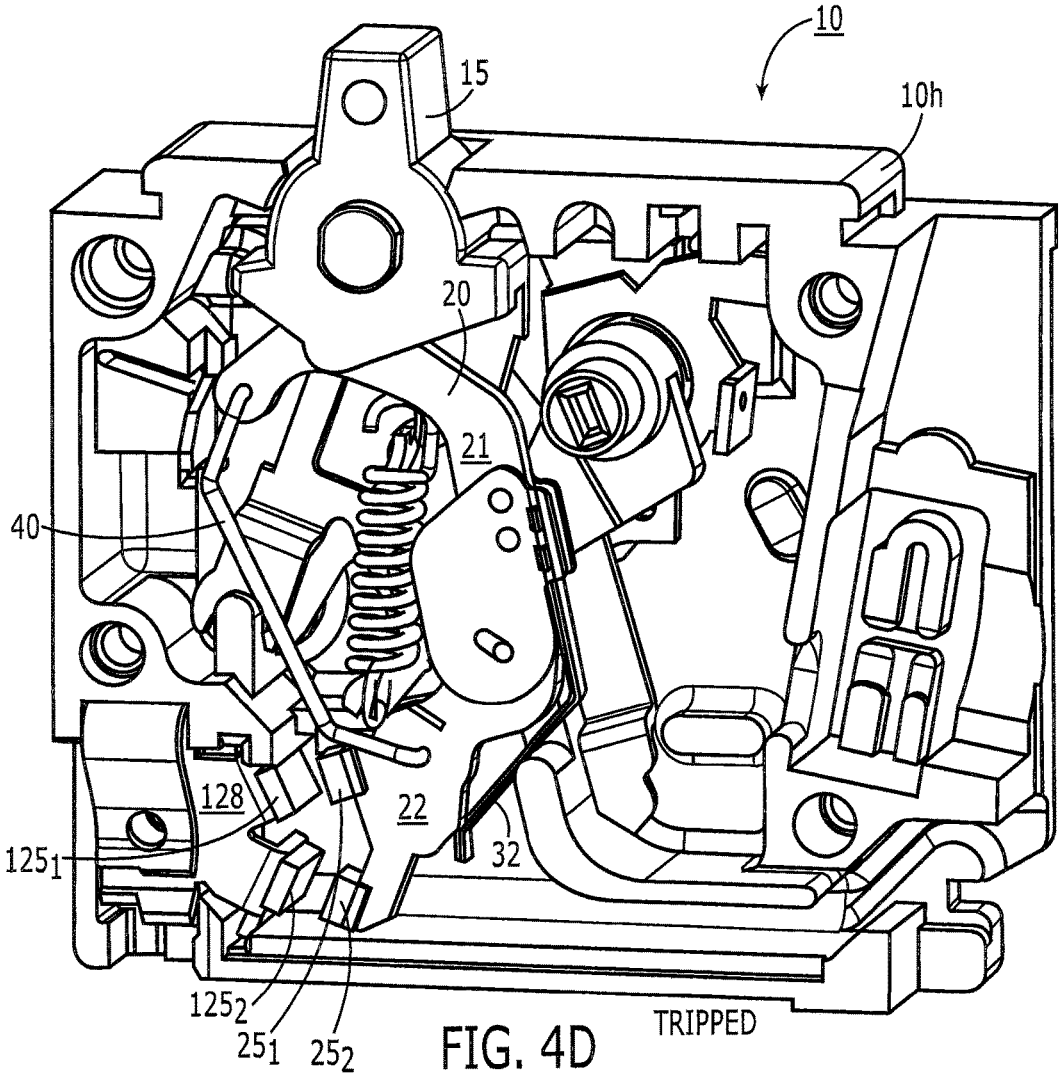
FIG. 4D is a side cutaway view of the circuit breaker shown in FIG. 4A illustrating an exemplary TRIPPED configuration according to embodiments of the present invention.

FIG. 4C illustrates that both contacts $25_1$, $25_2$ are spaced apart from the stationary contact(s) in the OFF position. The spacing can be greater than the separation during ON or Opening, e.g., between about 0.10 and 0.30 inches, typically between about 0.200 to about 0.250 inches for each pair of opposing contacts $25_1$, $125_1$ and $25_2$, $125_2$, such as about 0.234 and 0.204 inches, respectively. FIG. 4D illustrates an exemplary TRIPPED configuration, again with both moving contacts 25 spaced apart from the stationary contact(s) 125, but typically closer to the stationary contacts than when in the OFF position shown in FIG. 4C. The TRIPPED separation distance is typically between about 0.100 to about 0.225 for each pair of opposing contacts $25_1$, $125_1$ and $25_2$, $125_2$, such as between about 0.117 and 0.105 inches, respectively.

Figure 5A:
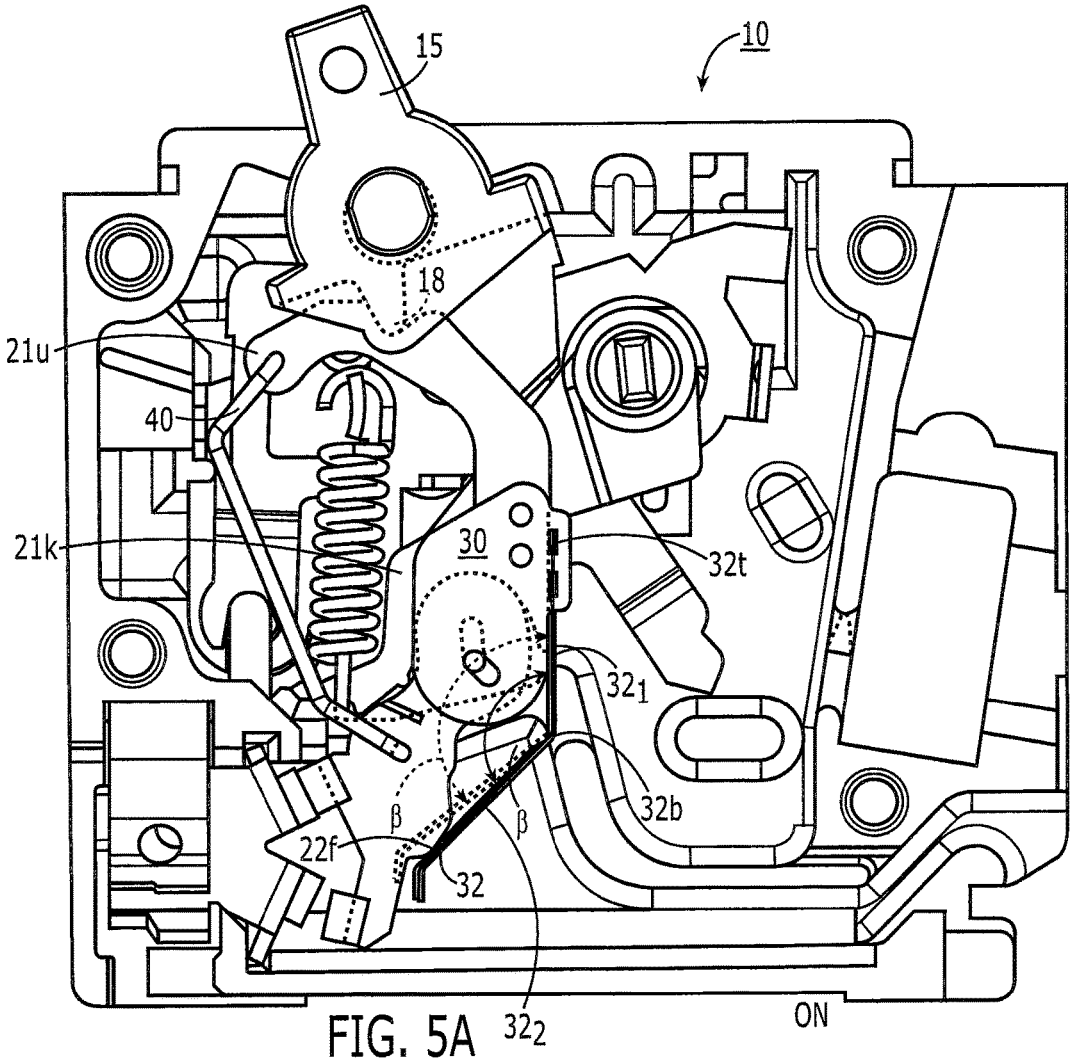
FIG. 5A is a side cutaway view of a circuit breaker illustrating an exemplary ON configuration with exemplary positional movement of the cooperating moving contact arm members according to embodiments of the present invention.
Figure 5B:
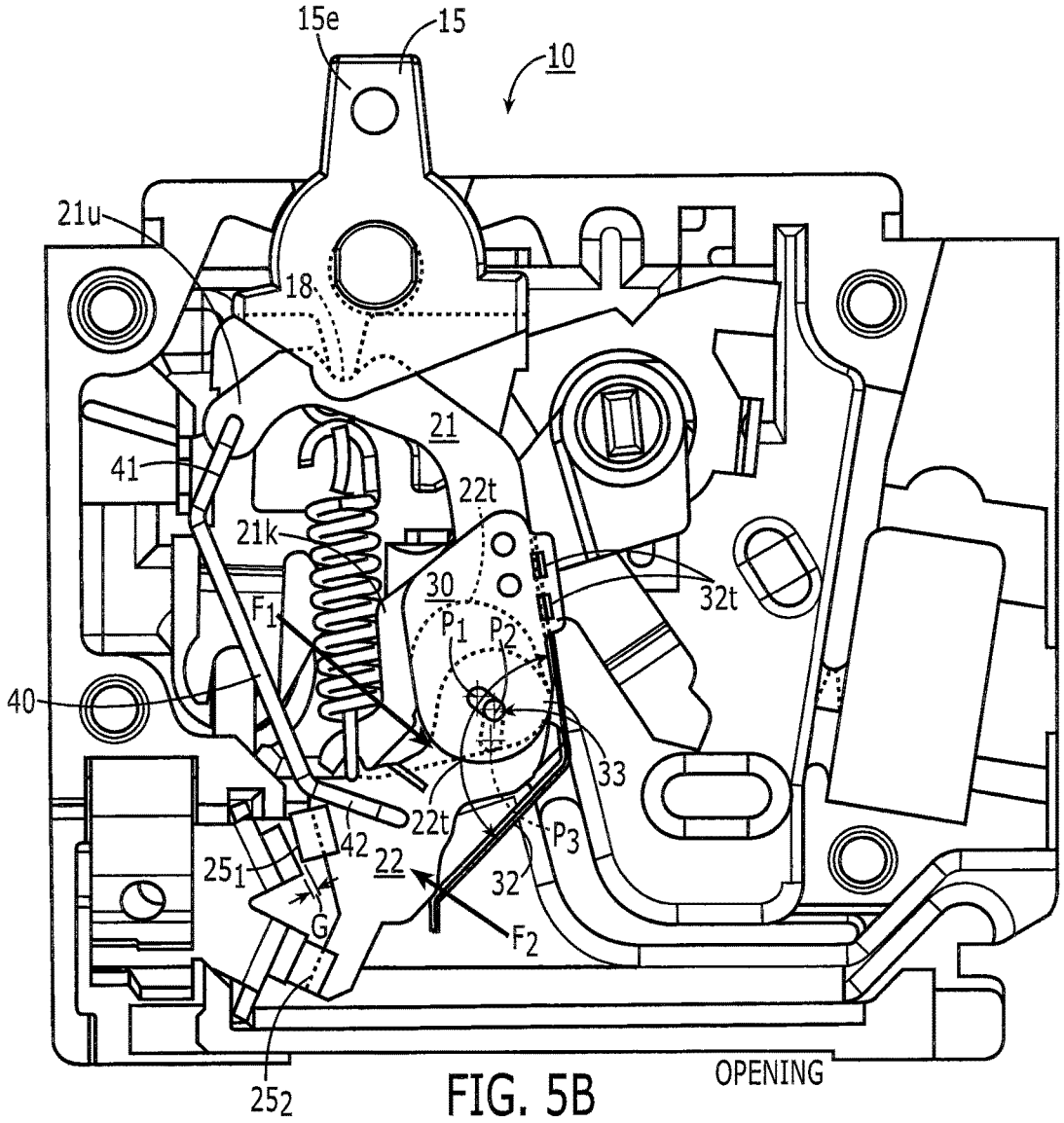
FIG. 5B is a side cutaway view of the circuit breaker shown in FIG. 5A illustrating an exemplary OPENING configuration with exemplary force vectors according to embodiments of the present invention.

Referring to FIGS. 5A, 5B and 8A the resilient member 32, where used, can flex so that the lower leg can move up and down relative to the first arm member 21 and/or coupler 30. The resilient member 32 can comprise a leaf spring and/or other flexible, resilient member. As shown, the resilient member 32 has a shape that includes first and second linear segments $32_1$, $32_2$ with a bend 32*b* therebetween. FIG. 5A shows that the second linear segment $32_2$ can extend at an angle "β" from the first linear segment $32_1$. The angle β can be between 100 and 145 degrees, such as between about 125 and 136 degrees, in some particular embodiments. Optionally, the angle β may change during movement of the first and second arm members 21, 22 as the lower segment $32_2$ flexes and remains in contact with a back side of the second arm member 22. In some particular embodiments, the angle β can change by between 4 and 10 degrees, and with an angle that is between 128.6 degrees and 135.5 degrees.

Embodiments of the invention are configured to keep the arc at the second contact $25_2$ close to the arc chute 75 (FIG. 6) during an arcing event, where the arc needs to jump to. Embodiments of the invention keep the first contact $25_1$ above the second contact $25_2$ and arcing, to keep the first contact $25_1$ in good and/or pristine condition without damage from arcing (or at least substantially reduced from conventional breakers). Embodiments of the invention configure the arm 20 to have a low or minimal resistance to allow for a cool (relatively low temperature) device. The arm 20, e.g., upper and lower arm members 21, 22 and the stationary contact support 127 can comprise copper or other suitable conductive material. Advantageously, embodiments of the present application configure the moving contact arm 20 to arc across only the second contact $25_2$ and avoid arcing across the first contact $25_1$. The first contact $25_1$ can have a higher silver amount than the second contact. The first contact $25_1$ can be configured for ON operation and not for arcing. The second contact $25_2$ can be for arcing, opening and closing operations but typically not for ON (e.g., continuous use) operation.

Embodiments of the invention configure the arm 20 so that the lower arm member 22 can rock the first and second spaced apart contacts $25_1$, $25_2$ to have a heel/toe engagement sequence for the two separate contacts $25_1$, $25_2$. The moving arm 20 can rock from the first (continuous use) contact $25_1$ to the arcing contact $25_2$ immediately before separating from the stationary contact $125_1$ whereby the arc is drawn between the two contacts $25_2$, $125_2$. Upon closing, the arcing contact $25_2$ can mate first with its stationary contact $125_2$ and the continuous use contact $25_1$ will then mate/engage with its stationary contact $125_1$.

FIGS. 4A-4D illustrate operational positions of the contacts $25_1$, $25_2$ and movement of the two arm members 21, 22 relative to each other via a pin 33 and cooperating slots 30*s*, 22*s* so that the sequence of movement of the first and second contacts $25_1$, $25_2$ to the respective stationary contacts $125_1$, $125_2$, can direct an arc to travel only across the second contact $25_2$ adjacent the arc chutes. As shown in FIG. 4A, in an ON position, the first contact $25_1$ contacts the stationary contact $125_1$. Prior to an arcing event, the arm 22 can rock to disengage the first contact $25_1$ immediately after the second contact $25_2$ engages the respective stationary contact $125_2$.

In conventional circuit breakers, the contact 25 opens exactly opposite: the "ON" position is at the bottom and the "opening" position is located at the top of the contact, but the arc chutes 75 (FIG. 6) are at the bottom, so this can draw an arc from the top of the contact and down (across) the face of both the stationary and moving contacts to the bottom where it then jumps into the arc chute 75. Advantageously, embodiments of the present application configure the moving arm 20 to arc across only a small region at the second contact $25_2$ and avoid arcing across the first contact $25_1$.

Figure 7A:
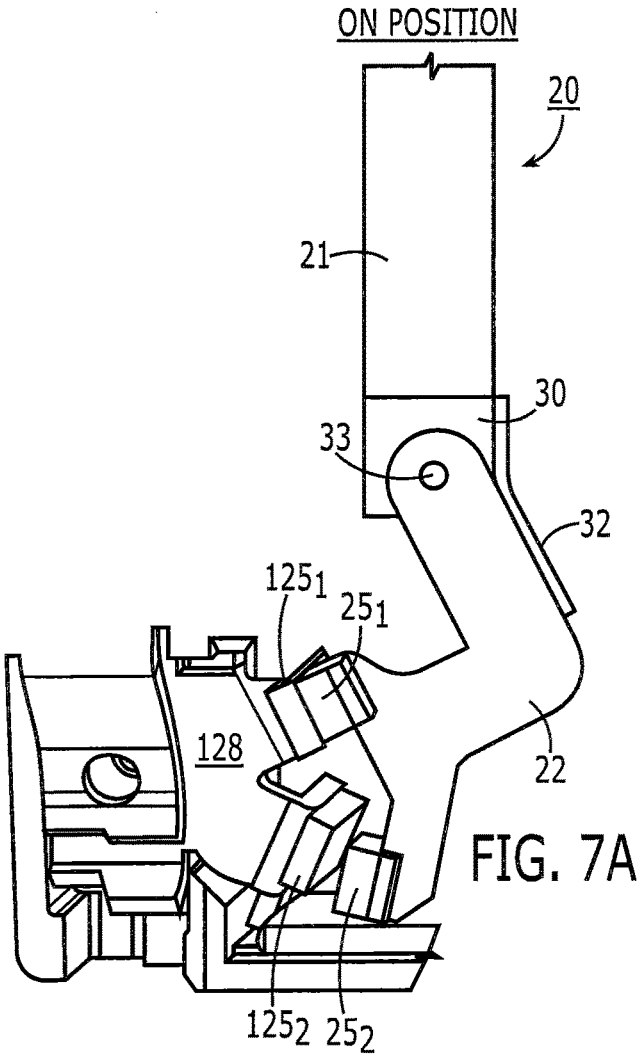
FIG. 7A is a schematic illustration of another embodiment of the cooperating arm members of the moving contact arm in an ON position according to embodiments of the present invention.
Figure 7B:
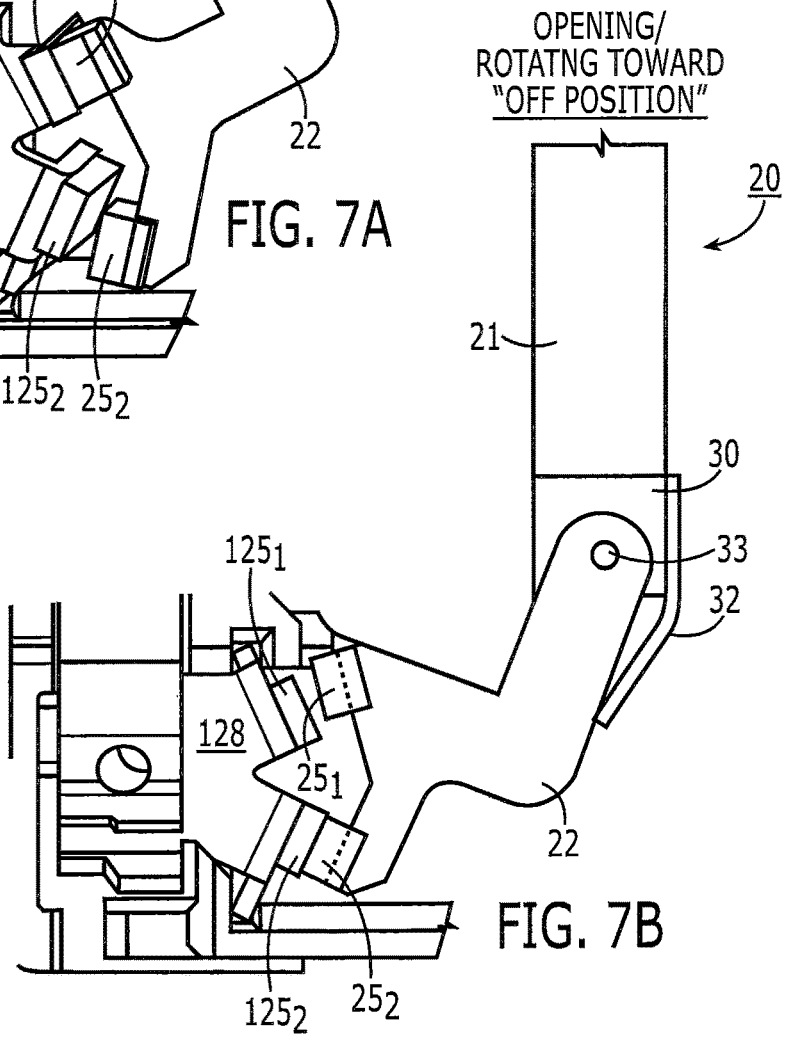
FIG. 7B is a schematic illustration the components shown in FIG. 7A illustrating a rotating toward OFF position or OPENING configuration according to embodiments of the present invention.

While a coupler 30 is shown to allow the pivoting movement of the two arm members 21, 22 relative to each other, the arm members 21, 22 may be directly attached, e.g., a pin 33 may extend through each arm 21, 22 as shown in FIGS. 7A and 7B, for example. Other coupler configurations and attachment configurations of the two arm members 21, 22 may be used to provide the relative movement of the arm members and the desired selective independent electrical engagement of the first and second moving contacts $25_1$, $25_2$ with the stationary contact(s) 125. The arm members 21, 22 can comprise different conductive materials or different percentages of conductive material, e.g., copper.

During endurance testing per UL 489, the arm 20 rapidly repetitively moves through its operative positions. Operational requirements from UL's "X" Program called "Overload" currently requires a breaker to be toggled 50 times at six (6) times rated current. For a 150 Amp breaker, the six (6) times test current is 900 Amps, which is arcing the contacts 25, 125 fifty (50) times. Afterwards, a temperature rise test is performed and the temperature rise cannot exceed 50 degrees C. It is contemplated that the new cooperating arm members 21, 22 will meet the overload temperature rise requirement, and, indeed, be able to operate at a maximum temperature rise defined by the noted UL Overload test of 50 degrees C.

The effectiveness of contact performance is typically directly proportional to the amount of silver in the contacts, which can be an expensive component of a breaker 10. Embodiments of the invention allow a reduction in the percentage of silver in one or more of the contacts $25_2$, $125_2$ (e.g., the second "arcing contact" $25_2$ and/or portions of a single larger stationary contact or one or both of first and second stationary contacts $125_1$, $125_2$, where two spaced apart stationary contacts are used), potentially allowing for a substantial cost reduction. Today some contacts are 50% Ag by weight, although 70% and up to 97% may be useful. It is contemplated that one or more of the contacts $25_2$, $125_2$ can have Ag in a range as low as about 25% by weight. Embodiments of the invention can have stationary and/or moving contacts 25, 125 with Ag content between about 25%, and 97%, including about 25%, about 30%, about 35%, about 40%, about 45%, about 50%, about 55%, about 60%, about 65%, about 70%, about 75%, about 80%, and about 90%. As noted above, the continuous use or first contact $25_1$ and/or stationary contact $125_1$ can have a greater percentage of silver than the arcing or second contact $25_2$ and/or stationary contact $125_2$. In some embodiments, the first contact $25_1$ can have 10-50% greater silver than the second contact $25_2$. For example, the first contact $25_1$ and/or $125_1$ can comprise between 60-97% silver and the second contact $25_2$ and/or $125_2$ can comprise between 25-50% silver.

In some embodiments, in the "ON" position (FIG. 4A), the cooperating arm members 21, 22 are configured so that the first contact $25_1$ is touching the stationary contact $125_1$ and as the arm 20 is opening (FIG. 4B) and travels to the "OFF" position (FIG. 4C), a resilient member 32 such as, but not limited to, a spring, can force the lower/second member 22 to rock in an opposing direction so that the other contact $25_2$ will separate and arc.

Figure 8:
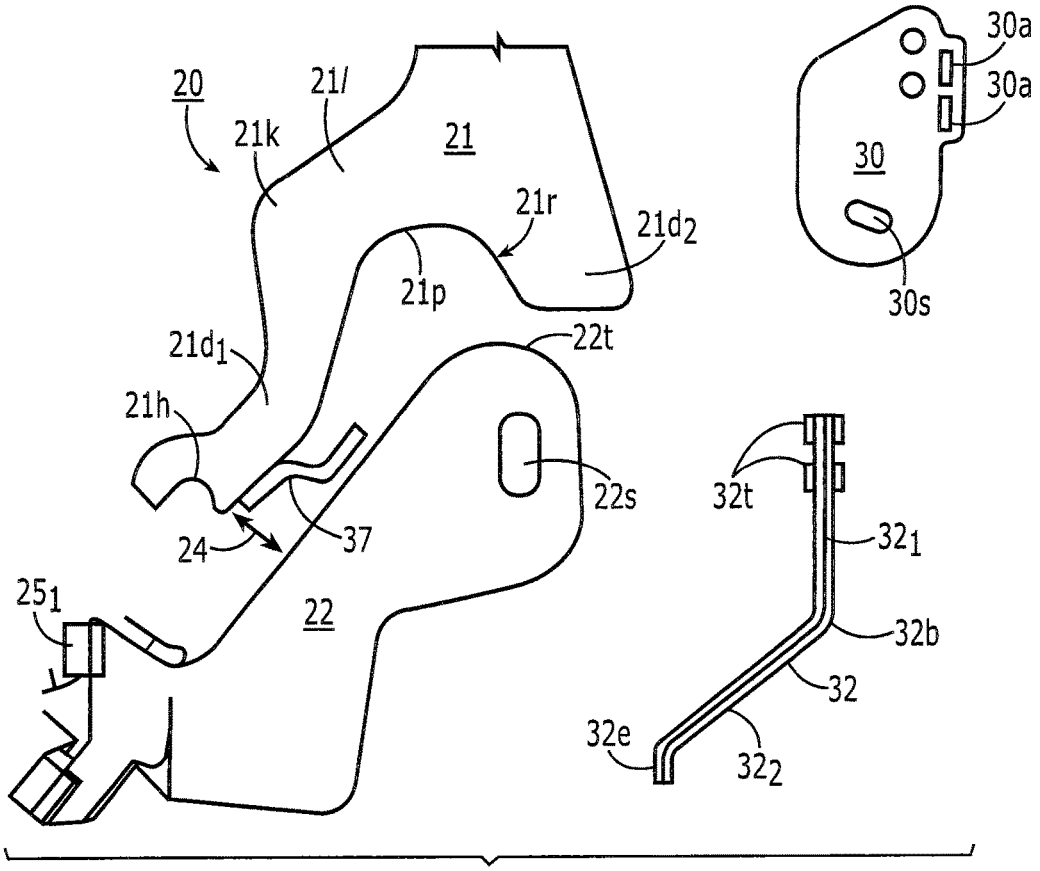
FIG. 8 is a schematic illustrations of cooperating arm members and a resilient member according to embodiments of the present invention.

The coupler 30, where used, can be pinned, screwed, nailed, riveted (27, FIG. 4), welded, brazed, adhesively attached or combinations thereof or otherwise fixedly secured to a lower end portion of the upper/first arm member 21. Referring to FIGS. 4B and 8, for example, the lower end of the first member 21*l* can have a spring engagement feature 21*h*, such as a hook, to engage the lower end of the mechanism spring 65. The lower end portion of the first/upper member 21*l* can have a curvilinear pocket 21*p* (FIG. 6) that extends inward from the spring engagement feature 21*h* that can slidably receive the upper end portion 22*t* of the lower/second arm member 22. As shown in FIG. 8, the upper end portion 22*t* of the lower arm member facing the pocket 21*p* of the upper arm member 21 can have a curved shape and can hold the elongate slot 22*s*.

Referring again to FIG. 4B, when the second contact $25_2$ engages the lower end of the stationary contact 125 or the second stationary contact $125_2$ as shown, as the arm 20 rotates toward the OFF position, the lower end of the first/upper arm member 21 (proximate the spring engagement feature 21*h*) adjacent the second arm member 22 can be spaced apart by a gap 24. FIG. 4A illustrates that in the "ON" position, the first contact $25_1$ engages the first stationary contact $125_1$ (which can alternatively be the top of a single stationary contact 125) and the lower end of the primary body with the first contact lower end of the first/upper arm member 21 is closer to the lower arm member 22.

Referring to FIG. 8, the first arm member 21 can have a ramp 21*r* that, in use, can be continuously in contact with the upper part of the lower arm 22*t*. The gap size 24 for the space between the hook arm 21*h* and the adjacent part of the second arm 22 may be such as to provide at least about a 0.020 inch clearance, typically between about 0.020 and 0.050 inches to provide for any tolerance stack up during assembly.

As shown in FIG. 8, the first arm member 21 can have a lower end portion 21*l* that can split into two downwardly extending segments $21d_1$, $21d_2$, each with a width W that is less than a width of the second arm member 22 at the top, medial or even bottom segments thereof.

FIGS. 5A, 5B, and 8 illustrate that the lower end portion of the first/upper arm member 21*l* can optionally include a knee 21*k* that faces the mechanism spring 65. Where used, the knee 21*k* can be configured to engage the mechanical spring 65 only after full rotation to the first contact $25_1$ engagement with the stationary contact $125_1$. The knee 21*k* can be configured to engage the spring 65 immediately after the opening position to push ("kick") the arm 20 open. The knee 21*k* can be configured to be timed to engage the spring 65 immediately after the opening shown in FIG. 5B so that the spring 65 kicks the contacts but does not do so too early to keep the separation distance of the contacts $25_1$, $125_1$ and $25_2$, $125_2$, as shown in FIG. 5B, for example.

FIGS. 4A-4D, 5A and 5B illustrate that the circuit breaker 10 may include a link 40 that has an upper end portion 41 that is attached to an upper end portion 21*u* of the first/upper arm member 21 and a lower end portion 42 that is attached to the second arm member 22. The link 40 can rotate the lower arm 22 as the arm 20 starts to rotate and force the pin(s) 33 to slide from P1 to P3 (FIG. 5B) for full rotation of the lower arm for a suitable gap or separation distance G, e.g., about 0.030 inches per FIG. 5B, for example, and/or to exaggerate the heel/toe and/or rocking action of the moving separated contacts $25_1$, $25_2$.

Figure 6:
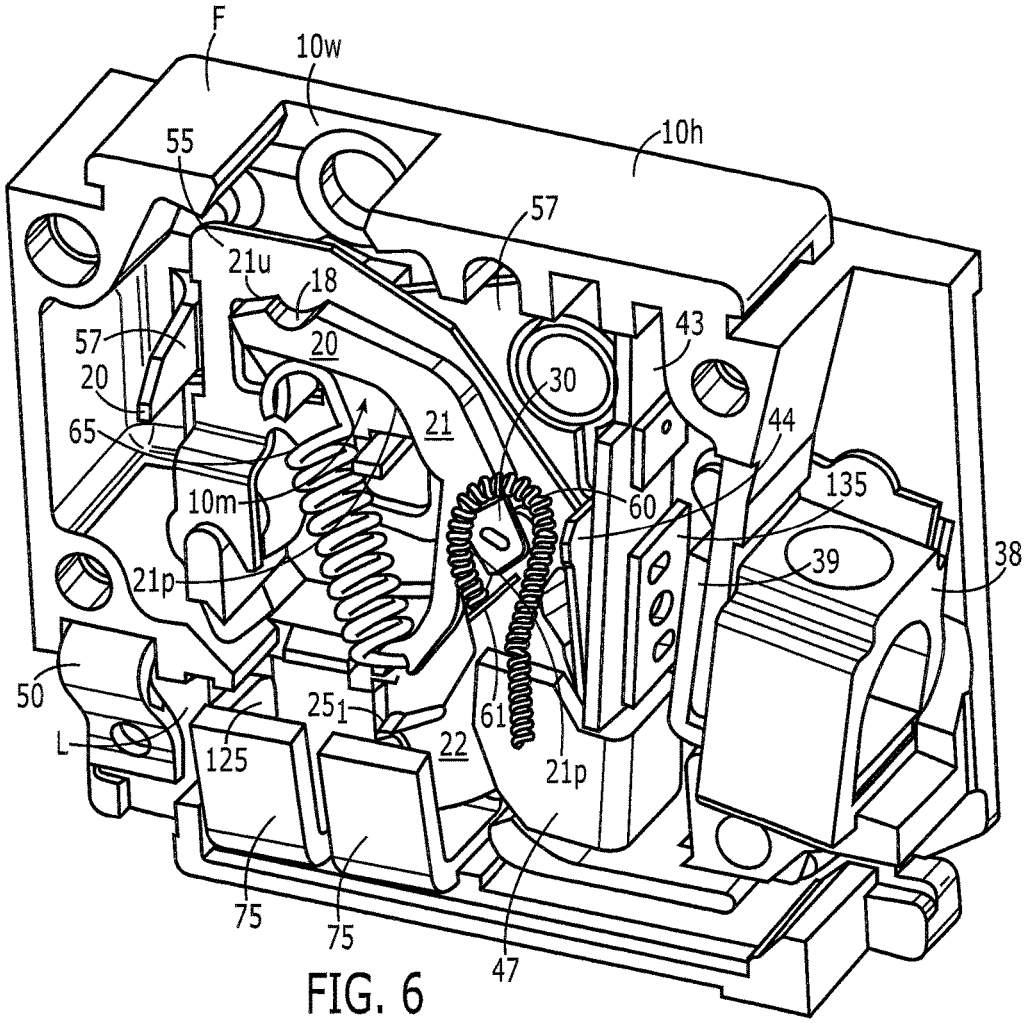
FIG. 6 is a side cutaway isometric view of an exemplary circuit breaker with the cooperating first and second moving arm members illustrating a shunt and other components of a circuit breaker according to embodiments of the present invention.

The lower/second arm member 22 can have a shunt attachment member 61 that engages a shunt 60 (FIG. 6).

FIG. 5B illustrates exemplary positions and exemplary spring force vectors F1, F2 that can be used to provide the desired rocking (e.g., heel-toe) action for the first and second contacts $25_1$, $25_2$ at the defined breaker operational conditions according to embodiments of the present invention. The upper end 22*t* of the lower arm member 22 can move up and down relative to the upper member 21 between operative positions. In some embodiments, the pin 33 translates in the aligned elongate slots 30*s*, 22*s* to move to positions $P_1$, $P_2$ and $P_3$.

Still referring to FIG. 5B, spring force vector F1 is configured to force the lower arm member 22 up from position P3 to P1. The ramp 21*r* of the pocket 21*p* (FIG. 6) of the upper arm member 21 can be configured to ensure that the lower arm 22 with slot 22*s* having position P3 does not slide up to P2. The opening position (FIG. 4B, 5B) can be an important position in the mechanism. This is the exact moment that the contacts start to separate and start to draw an arc (e.g., "immediately prior" to arcing) between the moving and the stationary contacts. In some embodiments, the steel arc chutes 75 (FIG. 6) magnetically attract this arc and direct (suck) it into the steel, cooling & extinguishing it. Spring force F2 can rotate the lower arm 21 clockwise when opening. The force of the main mechanism spring 65 is stronger than spring force F2 so it can rock the lower arm 22 counter clockwise once in the "ON" position.

The lower resilient member 32 (FIGS. 1, 4A-4D, 5A, 5B) can extend down off the upper arm 21 any suitable distance and can generate the spring force F2. FIG. 5B shows that the resilient member 32 can extend down below the rear medial portion of the lower arm 22 to provide a force vector F2 in a direction opposing the direction of the spring force vector F1. The resilient member 32 can be made of at least one flat piece of spring steel. In some embodiments a plurality of stacked spring steel pieces or members can be used such as to form a leaf spring configuration. Each spring (steel) member can have the same or different thickness, typically between about 0.02 and 0.5 inches thick, more typically between about 0.02 inches and 0.05 inches thick, bent into a defined shape. In some particular embodiments, three stacked spring members of a thickness of about 0.025 inches can be used for the resilient member 32, having a cumulative thickness of about 0.075 inches. Thus, in some embodiments, the resilient member 32 can comprise one or more cantilevered pieces of flat spring steel that's bent into the desired shape. The spring 32 can be a leaf spring or other spring configuration such as formed spring steel or combinations of different spring configurations, e.g., coil and leaf and/or resilient/elastic members.

The two arm members 21, 22 are typically pivotably attached together. The resilient member 32 can extend to a back side of the lower arm to provide a bias to force the lower member 22 to kick and/or rotate forward to a desired operative position(s).

FIGS. 5A, 5B and 8 show that the resilient member 32 can have a shape that includes first and second linear segments $\mathbf{3}_{21}$, $\mathbf{3}_{22}$ with a bend 32*b* therebetween. Also, the resilient member 32 can include tabs 32*t* that extend through apertures 30*a* in the coupler 30 to hold the upper portion of the resilient member in position. The second linear segment $\mathbf{3}_{22}$ and the lower end of the resilient member 32*e* can be a free-floating so as to be able to move up and down/flex.

In some particular embodiments, a separate resilient member (e.g., spring) 37 can be used to transmit the force vector F1 and can reside in the gap space 24 (FIG. 8) above the lower arm member 22 as shown in FIG. 8. The resilient member 37 (e.g., shaped spring steel or shape memory material, coil or leaf spring) can be attached to a lower end $\mathbf{21}d_1$ of the upper arm 21, typically adjacent the mechanism holding feature 21*h*. However, other placement and attachment configurations may be used and the member 37 is not required.

Referring to FIG. 6, as is well known, the circuit breaker 10 includes at least one arc chamber having at least one arc chute 30 with arc plates, a mechanism assembly 10*m* with the arm 20 holding the spaced apart contacts $\mathbf{25}_1$, $\mathbf{25}_2$ (e.g., a moving contact attached to the "contact arm") and the at least one stationary contact 125 proximate a line terminal L. The arm 20 is conductive, typically non-ferromagnetic metal such as, but not limited to, copper. As noted above, the upper arm member 21 and lower arm member 22 can be formed of the same or different metals. In some embodiments the upper arm member 21 is steel and the lower arm member is or comprises copper.

The handle 15 can include an external portion 15*e* (FIG. 5B) which can comprise a user actuator or input such as a lever, thumb or finger wheel or other suitable configuration. The handle can be attached to the housing directly or indirectly.

Still referring to FIG. 6, the circuit breaker 10 can also include one or more of a housing 10*h* with a window 10*w* for the handle 15, a magnet 135, a load collar 38, a load terminal 39, a bimetal member 43, an armature 44, a shunt bracket 47, a spring clip 50, a cradle 55 and frame 57. The circuit breaker 10 can have alternate configurations and components.

FIG. 6 also schematically illustrates a shunt 60 attached to the lower arm member 22 and a shunt bracket 47. The shunt 60 can be resilient and/or flexible. FIG. 6 also schematically illustrates the mechanism spring 65 (also shown in FIGS. 1, 4A-4D, 5A and 5B) which is part of the operator mechanism 10*m*, as is well known to those of skill in the art.

The arm 20 and handle 15 can have defined operative positions, "OFF," "ON" and (optionally) "TRIP". The movements can be over a desired handle angulation, typically between about 45 degrees to about 90 degrees, more typically about 90 degrees between the "OFF" and "ON" positions with the "TRIP" position between the "OFF" and "ON". Typically, in use, the face F (FIG. 6) of the housing/circuit breaker is oriented to be vertical with the handle facing outward.

FIG. 8 is a schematic view of components of the conductive arm 20, including the upper arm member 21, the lower arm member 22 and the sleeve 30. The resilient member 37 for F1 can optionally be attached to the upper arm member 21 as shown. While embodiments of the arm members 21, 22 and exemplary attachment configurations have been described, other attachment arrangements and configurations of the upper and lower arm members are contemplated.

In some embodiments, the circuit breakers 10 can be DC circuit breakers, AC circuit breakers, or both AC (alternating current) and DC (direct current) circuit breakers.

The circuit breakers 10 can be rated for voltages between about 1V to about 5000 volts (V) DC and/or may have current ratings from about 15 to about 2,500 Amps. The circuit breakers 10 may be high-rated miniature circuit breakers, e.g., above about 70 A in a compact package. However, it is contemplated that the circuit breakers 10 and components thereof can be used for any voltage, current ranges and are not limited to any particular application as the circuit breakers can be used for a broad range of different uses.

The circuit breakers 10 can be molded case circuit breakers (MCCB)s. MCCBs are well known. See, e.g., U.S. Pat. Nos. 4,503,408, 4,736,174, 4,786,885, and 5,117,211, the contents of which are hereby incorporated by reference as if recited in full herein.

The circuit breakers 10 can be a bi-directional DC MCCB. See, e.g., U.S. Pat. No. 8,222,983, the content of which is hereby incorporated by reference as if recited in full herein. The DC MCCBs can be suitable for many uses such as data center, photovoltaic, and electric vehicle applications.

As is known to those of skill in the art, Eaton Corporation has introduced a line of MCCBs designed for commercial and utility scale photovoltaic (PV) systems. Used in solar combiner and inverter applications, Eaton PVGard™ circuit breakers are rated up to 600 Amp at 1000 Vdc and can meet or exceed industry standards such as UL 489B, which requires rigorous testing to verify circuit protection that meets the specific requirements of PV systems. However, it is contemplated that the circuit breakers 10 can be used for various applications with corresponding voltage capacity/rating. In some particular embodiments, the circuit breaker 10 can be a high-rating miniature circuit breaker.

Figure 9:
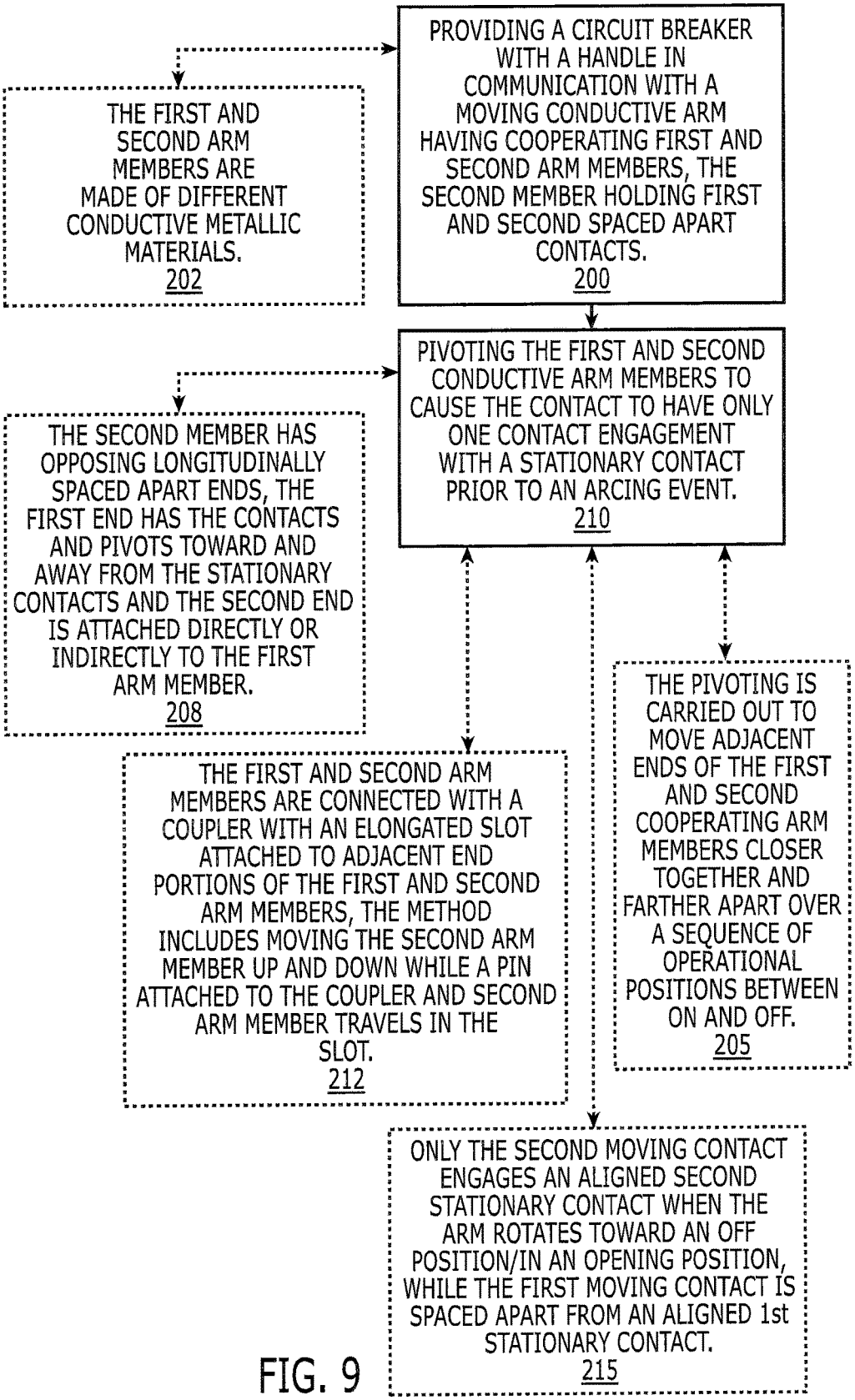
FIG. 9 is a flow chart of operational steps that can be used to operate a circuit breaker according to embodiments of the present invention.

FIG. 9 is a flow diagram of exemplary steps that can be used to operate a breaker. A circuit breaker with a handle in communication with a moving conductive arm having cooperating first and second arm members is provided. The second member holds first and second spaced apart electrical contacts (block 200). The first and second conductive arm members can be pivoted relative to each other to cause the contact to have only a first contact engagement, only a second contact engagement or concurrent first and second contact engagement with at least one stationary contact, including engagement with only the second electrical contact just prior to an arcing event (block 210).

The pivoting can be carried out to move adjacent ends of the first and second cooperating arm members closer together and farther apart over a sequence of operational positions between ON and OFF (block 205).

The first and second arm members can be made of different conductive metallic materials (block 202).

The second arm member can have opposing longitudinally spaced apart ends, the first end has the contacts and can pivot toward and away from the at least one stationary contact and the second end is attached directly or indirectly to the first arm member (block 208).

The first and second arm members can be connected with a coupler with an elongate slot attached to adjacent end portions of the first and second arm members. The method can include moving the second arm member up and down while a pin attached to the sleeve and second arm member travels in the slot (block 212).

Only the second contact $25_2$ of the arm 22 engages an aligned second stationary contact while the first contact is spaced apart from an aligned first stationary contact to thereby direct arcing directly into the arc chutes avoiding virgin contact surfaces thereabove (block 215).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A circuit breaker comprising:

an arc chute;

a pivotable handle;

a moveable contact arm, the contact arm having first and second cooperating arm members pivotably attached together, wherein the second arm member can move inward, outward and up and down relative to the first arm member, the first arm member having a first end portion attached to the pivotable handle and having a longitudinally spaced apart second end portion attached to the second arm member, the second arm member comprising a free end portion with first and second spaced apart electrical contacts, and wherein, with the handle oriented above the moveable contact arm, the first and second electrical contacts of the second arm member reside inside or adjacent and above the arc chute, with the second electrical contact below the first electrical contact; and a mechanism spring having an inwardly extending end portion attached to the first arm member at a location that is spaced apart from the second end portion of the first arm member that is attached to the second arm member, wherein the second arm member is configured to translate the first and second electrical contacts in a rocking action so that the first electrical contact moves away from a first stationary contact after the second electrical contact engages a second stationary contact immediately prior to an arcing event, wherein, with the handle oriented to be above the moveable contact arm, the first electrical contact is held by the second arm member above the second electrical contact facing the first stationary contact and the second electrical contact is held by the second arm member facing the second stationary contact, wherein, when a contact surface of the first electrical contact is in physical contact with the first stationary contact or a contact surface of the second electrical contact is in physical contact with the second stationary contact, planes drawn parallel to the contact surface of the first electrical contact and the contact surface of the second electrical contact intersect at a location between the first and second electrical contacts of the second arm member, wherein the second arm member has a shape that places the free end of the second arm member a distance forward of the second end portion of the first arm member, and wherein, in operation, (i) the second arm member moves relative to the first arm member to position the first electrical contact surface forward of the second electrical contact to contact the first stationary contact in an ON position of the circuit breaker for a first electrical contact only contact position and (ii) the second arm member moves relative to the first arm member to position the second electrical contact surface forward of the first electrical contact to contact the second stationary contact for a second electrical contact only contact position when the contact arm rotates toward an OFF position to thereby direct arcs across only the second electrical contact.

2. The circuit breaker of claim 1, wherein a lower end portion of the first arm member is pivotably directly attached to an upper end portion of the second arm member or is directly attached to a sleeve with a slot that is directly attached to the upper end portion of the second arm member to provide the pivotable attachment, and wherein the circuit breaker further comprises a link that extends from a top portion of the first arm member to the second arm member above the first and second contacts to rotate the second arm member and facilitate a rocking action when the first arm member starts to rotate.

3. The circuit breaker of claim 1, wherein the second electrical contact of the second arm member resides closer to a lower portion of the arc chute than the first electrical contact and angles downward, wherein the first electrical contact is a continuous use contact, and wherein the second electrical contact engages the second stationary contact while the first electrical contact is spaced apart from the first stationary contact when the contact arm moves toward an "OFF" position and/or in an opening position to thereby direct arcing into the arc chute.

4. The circuit breaker of claim 1, further comprising a single planar coupler with a curvilinear perimeter directly affixed to the first arm member, the coupler having a slot, wherein the second arm member comprises a slot, and wherein the slot of the coupler and the slot of the second arm member are aligned with a pin extending therethrough and allow the pin to travel inward, outward, upward and downward while the pin remains in the slots to place the second arm member and first and second electrical contacts in different positions to thereby provide the inward, outward, up and down movement of the second arm member relative to the first arm member.

5. The circuit breaker of claim 1, wherein the first and second electrical contacts both reside in front of the mechanism spring closer to the arc chute than the mechanism spring, wherein the first arm member applies a downwardly extending force vector to the second arm member, the circuit breaker further comprising a resilient member extending down from the first arm member to reside behind the second arm member, and wherein the resilient member applies an upwardly extending force vector to the second arm member.

6. The circuit breaker of claim 5, wherein the first arm member has a lower end portion with a curvilinear perimeter that faces the upper end of the second arm member, and wherein there is a curvilinear space between the lower end portion of the first member and the upper end of the second arm member, and wherein the circuit breaker further comprises a spring attached to the lower end portion of the first arm member spaced apart from the mechanism spring that transmits the downwardly extending first force vector to the second arm member.

7. The circuit breaker of claim 1, further comprising a resilient member that extends down from a back surface of the first arm member to reside behind a back surface of the second arm member, wherein the resilient member has first and second linear segments with the second linear segment angularly extending between about 100-160 degrees from the first linear segment, and wherein the first linear segment is attached only to the first arm member and the second linear segment contacts the back surface of the second arm member.

8. The circuit breaker of claim 1, wherein the second arm member holds the first electrical contact on one corner that resides closer to the handle than the second electrical contact, wherein the second arm member has a downwardly extending leg that holds the second electrical contact below the first electrical contact, and wherein the leg projects outwardly a greater distance than the corner from a primary body of the second arm member.

9. The circuit breaker of claim 1, wherein the first and second electrical contacts are spaced apart from each other from about 0.030 inches to about 0.234 inches, and wherein the second contact arm member has a primary body shape with a perimeter that extends inward between the first and second electrical contacts to define an open space with a valley medially between the first and second electrical contacts.

10. The circuit breaker of claim 1, wherein the second arm member comprises an upwardly extending slot, and wherein the circuit breaker further comprises a planar coupler that is directly attached to the first arm member and has an elongate slot, and wherein the coupler slot and the second arm member slot engage a pin that allows the second arm member to move relative to the first arm member through defined positions with the inward, outward, up and down movements.

11. The circuit breaker of claim 10, further comprising at least one shaped flat resilient member having first and second linear segments separated by a bend so that the second linear segment extends at an angle greater than 90 degrees away from the first linear segment, wherein the first linear segment is attached to and extends below the first arm member behind the second member to force the second arm member to rotate forward, and wherein the second linear segment extends above the first linear segment and above the second arm member and is attached to the first arm member.

12. The circuit breaker of claim 1, wherein the first arm member comprises a knee that resides above the lower end of the first arm member that faces the mechanism spring, wherein the lower end and knee of the first arm member each have a smaller width than a width of the second arm member adjacent thereto, and wherein the knee resides spaced apart a distance from an adjacent underlying portion of the second arm member.

13. The circuit breaker of claim 1, wherein the first and second spaced apart stationary contacts are held on a contact support.

14. The circuit breaker of claim 1, wherein, in operation, the second arm member moves relative to the first arm member to also (iii) position the first and second electrical contacts of the contact arm away from the first and second stationary contacts in the OFF and a TRIPPED position.

15. A method of operating a circuit breaker, comprising:

providing a circuit breaker with a moving contact arm having first and second arm members pivotally attached together, the second arm member comprising a free end with first and second spaced apart contacts that both face outward from a common side of the contact arm away from a mechanism spring, wherein a lower end of the mechanism spring is attached to a lower end portion of the first arm member in front of and adjacent to the pivot attachment of the first arm member to the second arm member;

rocking the first and second spaced apart electrical contacts against at least one stationary contact while allowing moving the first and second arm members relative to each other while the first arm member engages a handle and the mechanism spring so that the first contact is against the stationary contact, while the second contact is placed against the at least one stationary contact, then the first contact is moved away from the at least one stationary contact immediately prior to an arcing action after the second contact engages a respective at least one stationary contact; and directing arcing through the second contact and engaged stationary contact down into an adjacent arc chute providing an arc-free contact surface of the moving contact arm first contact, wherein the at least one stationary contact is configured as first and second spaced apart stationary contacts with the first stationary contact angled downward and the second stationary contact angled upward and with the second stationary contact aligned with the second electrical contact of the moving contact arm and the first stationary contact aligned with the first electrical contact of the moving contact arm, wherein, when a contact surface of the first electrical contact is in physical contact with the first stationary contact or a contact surface of the second electrical contact is in physical contact with the second stationary contact, planes drawn parallel to the contact surface of the first electrical contact and the contact surface of the second electrical contact intersect at a location between the first and second electrical contacts of the second arm member.

16. The method of claim 15, wherein the rocking step is carried out so that the first electrical contact of the moving contact arm is spaced apart from the first and second stationary contacts immediately prior to an arcing event.

17. The method of claim 15, wherein the first and second arm members are pivotally attached together with at least one pin and cooperating slots, wherein the second arm member has a primary body shape with a perimeter that extends inward between the first and second electrical contacts to define an open recess with a valley between the first and second electrical contacts, and a resilient member extending behind the second arm member, wherein the rocking step comprises translating the pin to move into different positions while held in the slots and pushing the second arm member to move relative to the first arm member to position the first and second electrical contacts against the first and second stationary contact in a defined sequence, and wherein the method further comprises applying spring force vectors to the lower arm member during the rocking action that (i) push an inner facing surface of the lower arm member downward and (ii) push an outer facing surface of the lower arm member inward.

18. The method of claim 15, wherein the method comprises applying a first spring force against the second arm member by mechanically pushing at least one resilient member against the second arm member to rotate the second arm member clockwise when opening and applying a second spring force using a spring attached to the first arm member of the moveable contact arm, the second arm member configured to move inward, outward and up and down relative to the first arm member whereby the second spring force is stronger than the first spring force so as to rock the lower arm member counter clockwise once in an "ON" position.

19. A circuit breaker comprising:

a housing;

a pivotable handle held by the housing;

an arc chute in the housing;

a moveable contact arm held in the housing, the arm having first and second cooperating arm members, the first arm member having a first end portion engaging the pivotable handle and an opposing bifurcated second end portion with first and second segments, the first second segment attached to the second arm member, wherein the second member has a free end comprising first and second spaced apart electrical contacts, and wherein the second member comprises an end portion above the free end and adjacent the second end portion of the first arm member with at least one elongate slot, wherein a pin extends through the slot and allows the second arm member to translate inward, outward, upward and downward relative to the first arm member;

a mechanism spring attached to the second segment of the first arm member; and first and second spaced apart stationary contacts in the housing, the first stationary contact aligned with the first electrical contact of the second arm member and the second stationary contact aligned with the second electrical contact of the second arm member, wherein, with the housing oriented to place the handle above the moveable contact arm, the first and second electrical contacts face the first and second stationary contacts with the second stationary contact inside the arc chute, wherein the first electrical contact of the second arm member moves to reside against only the first stationary contact and the second electrical contact of the second arm member moves to reside against only the second stationary contact, wherein, in an opening state and/or moving toward "OFF" position, prior to an arcing event, the first contact of the second arm member is spaced apart from first stationary contact while the second contact of the second arm member is against the second stationary contact to thereby direct arcing across a surface of the second contact into the arc chute and avoid arcing across surfaces of the first contact and the first stationary contact, and wherein, with the handle oriented to be above the moveable contact arm, (a) the first electrical contact is held by the second arm member above the second electrical contact and the second electrical contact is held by the second arm member, wherein planes drawn parallel to a contact surface of the first electrical contact and a contact surface of the second electrical contact intersect at a location between the first and second electrical contacts when the first and second electrical contacts are in physical contact with a corresponding one of the first and second stationary contacts and (b) the first stationary contact has an angle of inclination that is parallel to the first electrical contact and the second stationary contact has an angle of inclination that is parallel to the second electrical contact.

20. The circuit breaker of claim 19, wherein the angles of inclination are between 10-60 degrees from vertical, wherein the first segment of the bifurcated second end portion of the first arm member has a smaller width than a width of the second segment, and wherein the first segment resides spaced apart a distance from an adjacent underlying portion of the second arm member.

21. The circuit breaker of claim 19, wherein the second contact arm member has a primary body shape with a curvilinear perimeter that extends inward between the first and second electrical contacts to define an open space or recess with a valley medially positioned between the first and second electrical contacts.

* * * * *